US006758160B1

(12) United States Patent
Martin

(10) Patent No.: US 6,758,160 B1
(45) Date of Patent: Jul. 6, 2004

(54) HYDRANT LOCATOR

(76) Inventor: Erik Martin, 107 Ivy La., River Vale, NJ (US) 07675

( * ) Notice: Subject to any disclaimer, the term of this patent is extended or adjusted under 35 U.S.C. 154(b) by 0 days.

(21) Appl. No.: 10/064,506

(22) Filed: Jul. 23, 2002

(51) Int. Cl.[7] ..... E03B 9/06

(52) U.S. Cl. ..... 116/202; 116/209; 116/201; 340/331; 340/332; 441/13

(58) Field of Search ..... 116/202, 107, 116/200, 209, 280, DIG. 1, DIG. 43; 340/331–332, 691.1, 321; 441/13, 16

(56) References Cited

U.S. PATENT DOCUMENTS

| | | | | | |
|---|---|---|---|---|---|
| 2,467,908 | A | * | 4/1949 | Rand | 248/475.1 |
| 4,592,301 | A | * | 6/1986 | Monte | 116/67 R |
| D336,262 | S | * | 6/1993 | O'Neal | D10/111 |
| 6,239,701 | B1 | * | 5/2001 | Vasquez et al. | 340/539 |
| 6,260,507 | B1 | * | 7/2001 | Simpson et al. | 116/200 |
| 2001/0004482 | A1 | * | 11/2001 | Lanza | 455/92 |

FOREIGN PATENT DOCUMENTS

| | | | | |
|---|---|---|---|---|
| DE | 3536626 | A | * | 5/1987 |
| DE | 10138420 | A1 | * | 2/2003 |
| GB | WO-9118374 | A | * | 11/1991 |

* cited by examiner

*Primary Examiner*—Diego Gutierrez
*Assistant Examiner*—Tania Courson
(74) *Attorney, Agent, or Firm*—Richard A. Joel, Esq.

(57) ABSTRACT

This invention relates to a hydrant locator that facilitates the location of a hydrant by firefighters, particularly in an emergency. The low profile device wraps around the hydrant cylinder for mounting purposes and a switch in an emergency vehicle sets off strobe lights on the device upon activation to alert firefighters to the hydrant location. The locator device comprises a plurality of solar powered strobe lights that are strapped about the hydrant alternating with solar panels. A locked latch secures the locator belt of strobe lights and solar panels to the hydrant. A shatterproof shield is mounted over the strobe lights and solar panels. A receiver is also mounted within the locator to activate the strobe lights upon receipt of a remote signal. A remote switch located in an emergency vehicle is coupled to a transmitter to activate only those hydrant locators within a given range of approximately 1500 feet. The switch can activate a different color strobe light to indicate the closeness of the hydrant.

8 Claims, 2 Drawing Sheets

HYDRANT LOCATOR

BACKGROUND OF THE INVENTION

This invention relates to a hydrant locator that facilitates the location of a hydrant by firefighters, particularly in an emergency. The low profile device wraps around the hydrant cylinder for mounting purposes and a switch in an emergency vehicle sets off strobe lights on the device upon activation to alert firefighters to the hydrant location.

In fighting fires, time is a crucial factor and precious time is often wasted searching for a fire hydrant. Ideally, firefighters want to hook up to the nearest hydrant for purposes of water pressure and running less hose. Unfortunately, are often hidden by their surroundings such as bushes, trees, vehicles, etc. The present solution usually involves mounting a vertical metal flag or locator to the hydrant so it can be sighted by emergency personnel. These flags are generally unsightly, subject to vandalism and more importantly; they often fail in their main purpose since they too are obscured by surroundings. Maps showing the location of hydrants are also of little help in many situations since the firefighters are often not aware of the precise fire location or may be unfamiliar with the neighborhood.

The prior art includes U.S. Pat. No. 6,260,507 to Simpson, which discloses a reflective collar attachment, attached around the periphery of an existing fire hydrant including mating semi-circular halves, each of which has formed therewith a pair of integral semi-circular extensions with a number of circular stair-stepped indentations of incrementally decreasing radii. The two halves fit together. The device includes a display area, which receives and displays a web of color-coded reflective material indicating the flow rating of a particular hydrant.

Prior art U.S. Pat. No. 4,478,169 to Shrefler, discloses a conventional marking device comprising a mounting bracket adapted for attachment to a hydrant and an elongated stem projecting upwardly therefrom.

U.S. Pat. No. 6,114,949 to Astell, discloses a safety apparatus for providing information to a firefighter. The apparatus includes an activator mounted outside a building, which is activated by a firefighter in the event of a fire. A transmitter is coupled to the activator such that a signal is sent to the transmitter triggering a secondary signal. A receiver is located in each room of the dwelling. Each receiver receiving the secondary signal from the transmitter generates a pulse corresponding to the secondary signal activating a strobe light connected to the receiver. The strobe light is visible from outside the dwelling emitting a visible signal corresponding with the number of occupants within the room for indicating to the firefighter how many persons occupy each room of the dwelling. This patent shows a strobe light being selectively operated in the event of a fire to provide a signal to firefighters.

Also of interest are U.S. Pat. No. 6,081,188 to Kutlucinar, U.S. Pat. No. 5,877,681 to Williams, and U.S. Pat. No. 5,931,570 to Yamuro.

The prior art fails to disclose the unique hydrant proposed herein which involves a low profile mounting on a hydrant comprising strobe lights remotely activated from emergency vehicle.

SUMMARY OF INVENTION

This invention comprises a hydrant locator which is low profile and wraps around the cylinder of the hydrant but does not interfere with discharges from the hydrant. The locator device comprises a plurality of solar powered strobe lights that are strapped about the hydrant alternating with solar panels. A locked latch secures the locator belt of strobe lights and solar panels to the hydrant. A shatterproof shield is mounted over the strobe lights and solar panels. A receiver is also mounted within the locator to activate the strobe lights upon receipt of a remote signal.

In use, a remote switch located in an emergency vehicle is coupled to a transmitter to send a signal to the receiver activating only those hydrant locators within a given range of approximately 1500 feet. Further the switch can activate a different color strobe light to indicate the closeness of the hydrant.

Accordingly, an object of this invention is to provide a new and improved hydrant locator.

Another object of this invention is to provide a new and improved hydrant locator that includes strobe lights powered by solar panels.

A further object of this invention is to provide a new and improved low profile hydrant locator with strobe lights that are activated by a switch in an emergency vehicle.

A more specific object of this invention is to provide a new and improved hydrant locator, which comprises an alternate array of strobe lights and solar panels with a receiver, fastened about the hydrant cylinder and a transmitter activated by a switch in an emergency vehicle to provide a distinctive color light in the locator indicating the closest hydrant.

BRIEF DESCRIPTION OF DRAWINGS

The above and other objects of the invention may be more readily seen when viewing in conjunction with the accompanying drawings wherein.

FIG. 2 is a top view of the invention; and.

DETAILED DESCRIPTION

Figure 1:
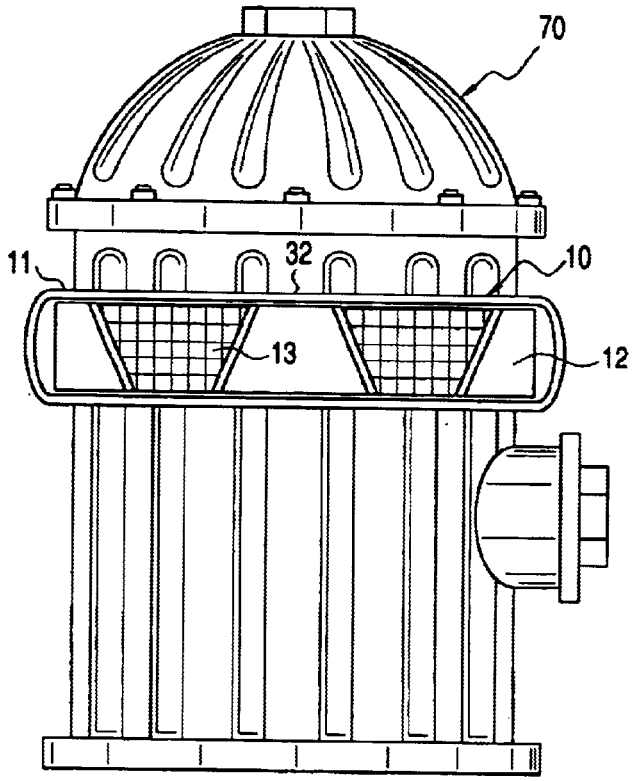
FIG. 1 is a perspective view of the hydrant locator comprising the invention.
Figure 2:
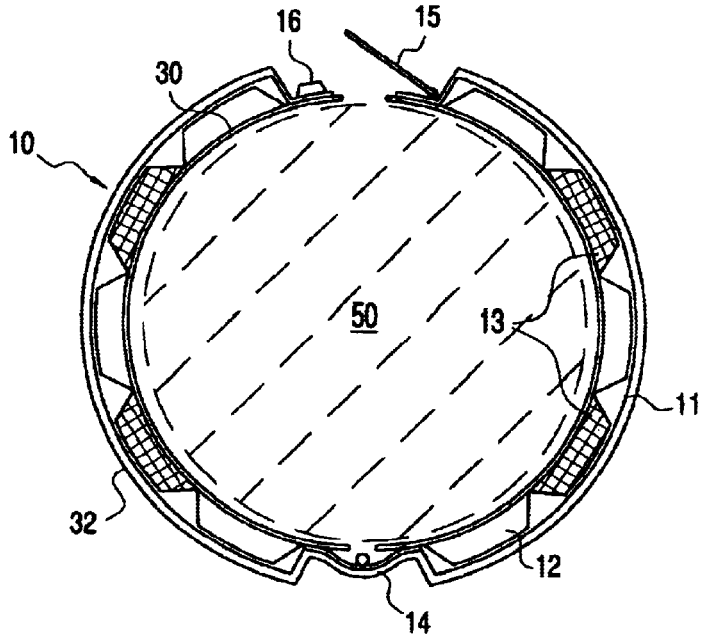

Referring now to FIG. 1 of the drawings, the hydrant locator 10, comprises a belt-like arrangement that fits about the cylinder of a fire hydrant (70). The belt 11 comprises a plurality of strobe lights 12 that alternate with solar panels 13 about the belt 11. The lights 12 and panels 13 are alternately frustoconical in configuration and are coupled electrically terminating in power packs 30 at each end of the belt 11. A hinge 14 is located at a point on the belt 11, 180° opposite a latch 15 which engages lock 16 to lock the belt 11 in position about the hydrant 50. A shatterproof shield 17 covers the solar panels 13 and strobe lights. A receiver 19 is coupled to the lights 12 within the locator 10 to activate the lights 12 upon receipt of a signal.

Figure 3:
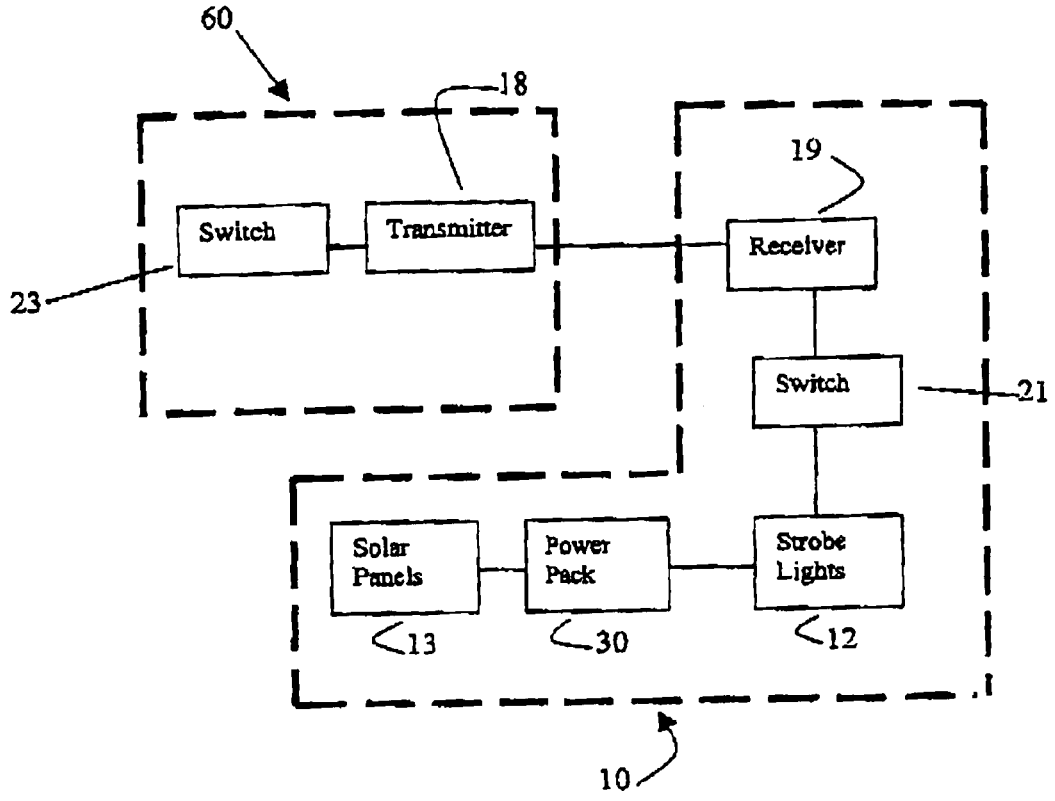
FIG. 3 is a schematic drawing illustrating the operation of the invention.

As shown in FIG. 3, a remote transmitter 18 in an emergency vehicle 60 transmits a signal to a receiver 19 in the locator unit 10 upon closing of switch 23. The receiver 19 activates a switch 21 that operates the strobe lights 12. The lights 12 draw power from the solar panels 13 via the power packs 30 and commence flashing. The transmitter 19 has a limited range so that only the locators 10 within a given radius of the vehicle 60 are operated. A typical distance would be 1500 feet. As a further feature the strobe lights 12 that are closer to the vehicle 60 may flash at a different speed or color to signify the closest hydrant 50. The other lights 12 would still flash if within the designated radius.

In use, an operator in an emergency vehicle 60 would push a switch 23 to activate the transmitter 18 to send a signal to fire hydrants 50 in the vicinity. When the vehicle 60 stops in the vicinity of a fire, the strobe lights 12 on the nearest hydrant 30 would be flashing a particular color. Other strobe lights 12 within a particular area would flash but at a different speed or a different color. The receiver 19 sends the signal to a switch 21 activating the strobe lights 12.

Thus, a highly visible, inexpensive, hydrant locator 10 is activated to save precious time. The power supply for the strobe lights 12 is solar powered and self-sufficient providing long life for the unit 10. A shatterproof shield 32 protects the locator 10 from vandalism.

While the invention has been explained by a detailed description of certain specific embodiments, it is understood that various modifications and substitutions can be made in any of them within the scope of the appended claims, which are intended also to include equivalents of such embodiments.

What is claimed is:

1. A hydrant locator in combination with a hydrant comprising:

a belt assembly detachably mounted about the cylinder of the hydrant and including a hinge and a latch located approximately 180° opposite the hinge, said latch comprising a lock to secure the belt about the hydrant;

a plurality of interconnected strobe light mounted to the belt;

a plurality of intermediate interconnected solar panels mounted to the belt alternating in an array with the strobe lights to generate an output power;

a power pack mounted to the belt to receive the output power from the solar panels;

a receiver mounted on said belt to receive a remote limited range activation signal;

a switch coupled to the receiver and operated by said activation signal to activate the strobe lights to indicate the position of the hydrant.

2. A hydrant with claim 1 further including:

a shatterproof glass shield mounted over the belt assembly to prevent damage thereto.

3. A hydrant with claim 1 further including:

a transmitter for sending an activation signal to the receiver; and, a switch for operating said transmitter.

4. A hydrant with claim 3 wherein:

the transmitter has a limited range to operate strobe lights within a predetermined radius.

5. A hydrant with claim 3 wherein:

the strobe lights operate at a predetermined speed depending on distance from the transmitter.

6. A hydrant with claim 3 wherein:

the strobe lights project a predetermined color depending upon distance from the transmitter.

7. A hydrant with claim 1 wherein:

the belt includes an intermediate hinge and opposite ends having a latch and mating lock mounted respectively on opposite ends to lock the belt about the hydrant cylinder.

8. A hydrant locator in combination with a hydrant in accordance with claim 7 wherein:

the belt includes a power pack mounted on each end of the belt adjacent the lock and the latch respectively, said power packs being connected to the strobe lights to operate said lights.

* * * * *